US010662029B2

(12) United States Patent
Vakkamaki et al.

(10) Patent No.: US 10,662,029 B2
(45) Date of Patent: May 26, 2020

(54) OVERSPEED GOVERNOR CONFIGURED TO TRIGGER AT DIFFERENT SPEED LEVELS FOR AN ELEVATOR

(71) Applicants: Henri Vakkamaki, Helsinki (FI); Tuukka Korhonen, Tuusula (FI)

(72) Inventors: Henri Vakkamaki, Helsinki (FI); Tuukka Korhonen, Tuusula (FI)

(73) Assignee: Kone Corporation, Helsinki (FI)

( * ) Notice: Subject to any disclaimer, the term of this patent is extended or adjusted under 35 U.S.C. 154(b) by 380 days.

(21) Appl. No.: 15/441,943

(22) Filed: Feb. 24, 2017

(65) Prior Publication Data

US 2017/0166418 A1 Jun. 15, 2017

Related U.S. Application Data

(63) Continuation of application No. PCT/FI2014/050661, filed on Aug. 29, 2014.

(51) Int. Cl.
*B66B 5/06* (2006.01)
*B66B 1/28* (2006.01)
(Continued)

(52) U.S. Cl.
CPC ..... *B66B 5/06* (2013.01); *B66B 1/28* (2013.01); *B66B 1/32* (2013.01); *B66B 5/0031* (2013.01);
(Continued)

(58) Field of Classification Search
CPC .... B66B 5/06; B66B 1/28; B66B 1/32; B66B 5/0031; B66B 5/22; B66B 7/06; B66B 7/068; B66B 9/00
USPC ..... 187/247, 248, 272, 285, 287, 288, 289, 187/291, 292, 293, 305, 314, 391, 393; 318/362–373, 375, 376, 377
See application file for complete search history.

(56) References Cited

U.S. PATENT DOCUMENTS 3,872,949 A * 3/1975 Snyder ..... B66B 5/06 187/352
4,108,282 A * 8/1978 Satoh ..... B66B 3/02 187/394
(Continued)

FOREIGN PATENT DOCUMENTS

CN 101389560 A 3/2009
EP 2177466 A1 4/2010

OTHER PUBLICATIONS

Chinese Office Action dated May 21, 2018 issued in corresponding Chinese Application No. 201480081596.0.
(Continued)

*Primary Examiner* — Anthony J Salata
(74) *Attorney, Agent, or Firm* — Harness, Dickey and Pierce, P.L.C.

(57) ABSTRACT

An overspeed governor including a governor sheave, a permanent magnet rotor coupled to the governor sheave, a stator arranged to interact with the permanent magnet rotor, a safety gear for braking movement of an elevator car and a safety rope fixed to the safety gear and arranged to run via the governor sheave. The stator includes a winding adapted to exert, when energized, to the permanent magnet rotor a braking force that brakes movement of the permanent magnet rotor and, consequently, movement of the governor sheave and the safety rope, thereby activating the safety gear.

15 Claims, 4 Drawing Sheets

(51) Int. Cl.

| | |
|---|---|
| ***B66B 1/32*** | (2006.01) |
| ***B66B 5/00*** | (2006.01) |
| ***B66B 5/22*** | (2006.01) |
| ***B66B 7/06*** | (2006.01) |
| ***B66B 9/00*** | (2006.01) |

(52) U.S. Cl.
CPC ..... *B66B 5/22* (2013.01); *B66B 7/06* (2013.01); *B66B 7/068* (2013.01); *B66B 9/00* (2013.01)

(56) References Cited

U.S. PATENT DOCUMENTS 5,797,472 A 8/1998 Kamani et al.
6,170,614 B1 * 1/2001 Herkel ..... B66B 1/32 187/287
6,227,334 B1 * 5/2001 Yumura ..... B66B 5/048 187/359
6,345,696 B1 2/2002 Yumura
7,353,916 B2 * 4/2008 Angst ..... B66B 5/0031 187/393
7,614,481 B2 * 11/2009 Okamoto ..... B66B 5/06 187/305
8,181,749 B2 * 5/2012 Okada ..... B66B 5/044 187/287
8,272,482 B2 * 9/2012 Takahashi ..... B66B 1/32 187/393
8,763,763 B2 * 7/2014 Kawakami ..... B66B 1/3492 187/247
9,604,819 B2 * 3/2017 Kattainen ..... B66B 5/0031
2011/0186385 A1 8/2011 Okada
2015/0053508 A1 * 2/2015 Kattainen ..... B66B 1/32 187/289
2016/0068368 A1 * 3/2016 Hovi ..... B66B 5/027 187/247
2017/0253460 A1 * 9/2017 Vakkamaki ..... B66B 1/32

OTHER PUBLICATIONS

International Search Report PCT/ISA/210 for International Application No. PCT/FI2014/050661 dated May 12, 2015.
Written Opinion of the International Searching Authority PCT/ISA/237 for International Application No. PCT/FI2014/050661 dated May 12, 2015.

* cited by examiner

OVERSPEED GOVERNOR CONFIGURED TO TRIGGER AT DIFFERENT SPEED LEVELS FOR AN ELEVATOR

FIELD OF THE INVENTION

This application is a continuation of PCT International Application No. PCT/FI2014/050661 which has an International filing date of Aug. 29, 2014, the entire contents of which are incorporated herein by reference. The invention is related to the art of overspeed governors for elevators.

BACKGROUND OF THE INVENTION

The safe operation of an elevator system is generally ensured with an overspeed governor. Overspeed governor includes a safety gear that grips the guide rail to stop an elevator car. Safety gear can be used for stopping the elevator car, counterweight or both. Safety gear is activated in an overspeed situation of the elevator car, for example.

Safety gear is linked to a governor sheave with a safety rope running via the governor sheave. Governor shave can rotate freely during normal elevator operation.

Mechanical activation means are arranged in connection with the governor sheave. Elevator car overspeed is observed when rotating speed of the governor sheave exceed a preset threshold. In that case centrifugal force causes moving of the activation means into position that locks rotation of governor sheave and therefore also movement of safety rope. This has the effect that safety gear turns into gripping position and stops movement of elevator car.

SUMMARY OF THE INVENTION

The above-disclosed overspeed governor has only one triggering speed level. On the other hand, travelling speed of elevator car may vary. It would be therefore useful to have an overspeed governor which can be triggered at more than one different speed levels depending on operation situation. For example, in some elevators safety would be enhanced if the overspeed governor was triggered at lower speed levels when elevator car is disposed in proximity of one of the elevator hoistway ends.

Therefore, it is object of the present invention to introduce an overspeed governor that can be triggered at two, even more speed levels according to the operating condition. This object is achieved with an overspeed governor and an elevator according to example embodiments. Some preferred embodiments of the invention are disclosed in dependent claims.

An aspect of the invention is an overspeed governor comprising a governor sheave, a permanent magnet rotor coupled to the governor sheave, a stator arranged to interact with the permanent magnet rotor, a safety gear for braking movement of an elevator car and a safety rope fixed to the safety gear and arranged to run via the governor sheave. Said stator includes a winding adapted to exert, when energized, to the permanent magnet rotor a braking force that brakes movement of the permanent magnet rotor and, consequently, movement of governor sheave and safety rope, thereby activating the safety gear.

Another aspect of the invention is an elevator, comprising an elevator car movable in an elevator hoistway along one or more guide rails. The elevator comprises an overspeed governor according to the disclosure. The safety gear of the overspeed governor is mounted to the elevator car and arranged to brake the car against the guide rail responsive to activation of the safety gear.

The term "activating the safety gear" means dragging the safety gear/component of safety gear by means of the safety rope to a position that causes the safety gear to grip guide rail.

The overspeed governor disclosed can be triggered at various speed levels by energizing the stator winding. Still another advantage is, that there is no mechanical contact in the triggering situation from stator to permanent magnet rotor, but the triggering/activation of safety gear takes place in a non-contact manner through interaction between stator and rotor.

According to an embodiment, the winding is disposed in the path of magnetic field of the permanent magnet rotor. This means movement of rotor causes rotating magnetic field, which induces source voltage in stator winding. Further, when stator winding is closed, said source voltage may energize the stator winding; therefore activation of safety gear does not require any additional current source.

According to an embodiment, an air gap is arranged between stator and permanent magnet rotor. Therefore, magnetic field from permanent magnet rotor runs from rotor to the stator over the air gap, such that triggering/activation of safety gear takes place in a non-contact manner.

According to an embodiment, said winding is adapted to exert, when energized, to the permanent magnet rotor a braking force that decelerates speed of the permanent magnet rotor, and consequently speed of governor sheave and safety rope, thereby activating the safety gear.

According to an embodiment, the winding has output terminals. The overspeed governor further comprises one or more controllable switches connected to said output terminals such that the one or more controllable switches are operable to selectively open or close the winding. This means that the winding may be energized or current through the winding may be cut off by controlling said one or more switches.

According to an embodiment, the overspeed governor comprises a control unit coupled to said one or more switches. The control unit may be a computer-implemented electronic control unit, or it may be implemented with discrete electronic components, with a relay logic or combination of them.

According to an embodiment, said control unit is configured to cause the one or more switches to selectively open or close the winding.

According to an embodiment, the control unit is configured to poll movement of an elevator car, to determine an emergency stop situation if movement of the elevator car is different from a desired movement, and to cause the one or more switches to close the winding based on the determined emergency stop situation.

According to an embodiment, said movement includes at least one of speed, acceleration, deceleration, and rotated distance of the permanent magnet rotor.

According to an embodiment, the control unit is configured to register starting of a new elevator run and to cause the one or more switches to open the winding based on the registered starting of a new elevator run.

According to an embodiment, the control unit is configured to register elevator car entering to a destination floor and to cause the one or more switches to close the winding based on the registered entering to a destination floor.

According to an embodiment, the control unit is configured to poll movement of the elevator car by polling movement of the permanent magnet rotor.

According to an embodiment, the control unit is configured to poll movement of the permanent magnet rotor by polling output voltage of the winding.

According to an embodiment, the control unit comprises a controllable switch coupled to an elevator safety chain, and the control unit is configured to cause said switch to open an elevator safety chain based on a determined emergency stop situation.

According to an embodiment, the overspeed governor comprises a tensioning pulley coupled to the safety rope for tensioning the safety rope.

According to an embodiment, the permanent magnet rotor includes plurality of permanent magnets arranged sequentially in the rotating direction.

According to an embodiment, least one of stator and permanent magnet rotor includes ferromagnetic material.

The aforementioned summary, as well as the additional features and advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

For the sake of intelligibility, in FIGS. 1-4B only those features are represented which are deemed necessary for understanding the invention. Therefore, for instance, certain components/functions which are widely known to be present in corresponding art may not be represented.

In the description same references are always used for same items.

Figure 1:
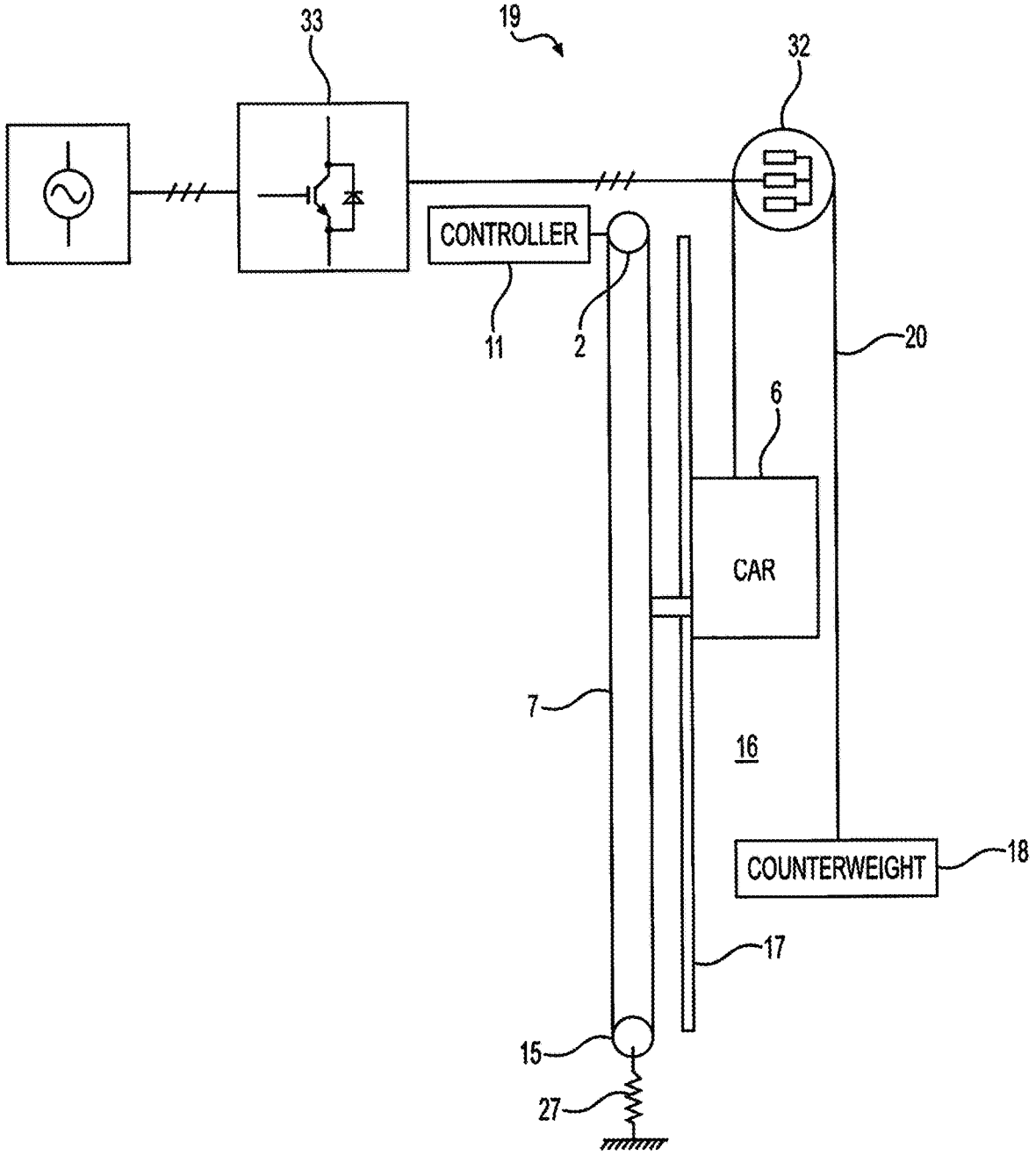
FIG. 1 presents an elevator comprising an overspeed governor according to the disclosure.

FIG. 1 presents an elevator having an elevator car 6 movable in an elevator hoistway 16 along one or more guide rails 17. An electric drive 19 (e.g. a hoisting machine 32 with a frequency converter 33) drives elevator car 6 and counterweight 18 via hoisting ropes 20 according to service requests from elevator passengers, as is known in the art.

Figure 2:
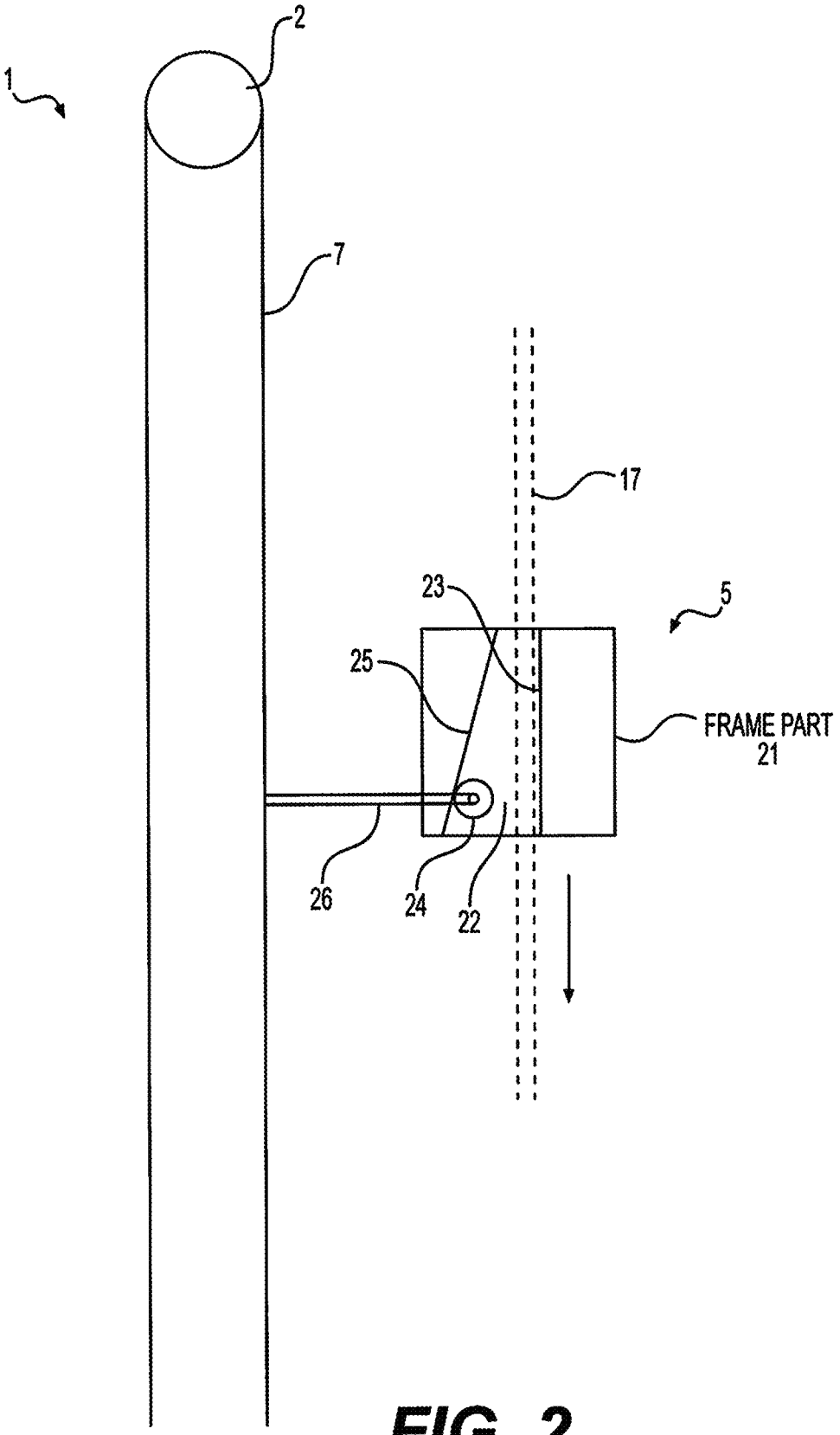
FIG. 2 presents some functional blocks of safety gear in FIG. 1 overspeed governor.

As discussed in more detail with regard to FIG. 2, the elevator includes an overspeed governor 1 for stopping elevator car 6 in overspeed situation. The overspeed governor of example embodiments is different from conventional overspeed governors such that it can be triggered at many different speed levels according to current operating condition. For example, lower triggering speed level may be adopted when elevator car is moving near hoistway pit or top of elevator hoistway, when the braking distance available is limited.

As illustrated in FIG. 2, the overspeed governor 1 comprises a safety gear 5 mounted to the elevator car 6. The overspeed governor 1 also comprises a governor sheave 2, which is suspended on a fixed structure at the uppermost part of the elevator hoistway 16. A safety rope 7 is fixed to the safety gear 5 and arranged to run via the governor sheave 2. The overspeed governor 1 comprises also a tensioning pulley 15 coupled to the safety rope 7 for tensioning the safety rope 7. Tensioning pulley 15 provides a tensioning force to the safety rope 7 by means of tensioning means, such as spring 27.

Governor shave 2 can rotate freely during normal elevator operation. In that case when elevator car 6 moves, safety gear 5 pulls safety rope 7, causing rotation of governor sheave 2.

The safety gear 5 is mounted to the elevator car 6 and arranged to brake the car 6 against the guide rail 17 responsive to activation of the safety gear 5. The frame part 21 is mounted in connection with the elevator car 6. The frame part comprises a housing 22, which contains a braking surface 23 towards the elevator guide rail 17. An elevator guide rail 17 is disposed inside the housing 22. Likewise, the housing comprises a roller 24, which meets the elevator guide rail 17 when the safety gear 5 operates. The roller 24 is disposed on a track 25 in the housing. The elevator guide rail 17 is between the braking surface 23 and the roller 24. The track 25 is shaped such that when the roller 24 moves on the track 25 in the direction of the guide rail 17, the guide rail presses against the braking surface 23 under the effect of the roller 24 producing gripping effect, which causes deceleration and stopping of movement the elevator car 6.

Activation of the safety gear 5 starts when the transmission means 26 that is in connection with the safety rope 7 pulls the roller along the track 25 upwards to grip the guide rail 17 (see FIG. 2). In practice this occurs by braking movement of the safety rope 7 with the governor sheave 2 when the elevator car 6 moves downwards, in which case the movement of the roller 24 decelerates with respect to the moving track 25 and the roller 24 moves into the gripping position in relation to the track 25.

The overspeed governor 1 comprises a permanent magnet rotor 3 and a stator 4 arranged to interact with the permanent magnet rotor 3. The permanent magnet rotor 3 is suspended coaxially with the stator 4 by means of a bearing such that the permanent magnet rotor 3 is operable to rotate relative to the stator 4. The permanent magnet rotor 3 is coupled to the governor sheave 2 such that the permanent magnet rotor 3 rotates with the governor sheave 2. Governor shave 2 can rotate freely during normal elevator operation. In that case when elevator car 6 moves, safety gear 5 pulls safety rope 7, causing rotation of governor sheave 2/permanent magnet rotor 3.

Alternative constructions of permanent magnet rotor 3 and stator 4 is represented in FIGS. 3A-3D. Stator 4 and permanent magnet rotor 3 are disposed opposite to each other with a distance constituting an air gap 28 between them. The permanent magnet rotor 3 includes plurality of permanent magnets 9 arranged sequentially in the rotating direction.

Figure 3A:
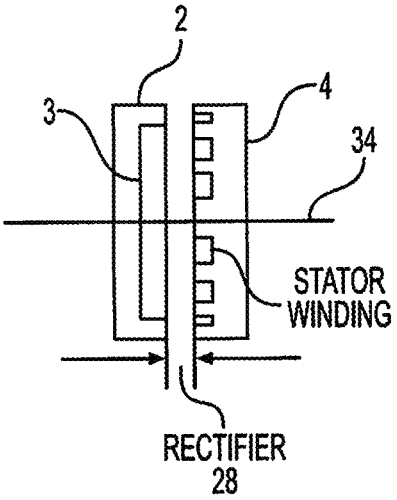
FIGS. 3A-3D present actuating means of the overspeed governor of FIG. 1.
Figure 3B:
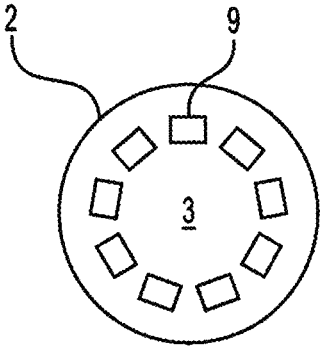
Figure 3C:
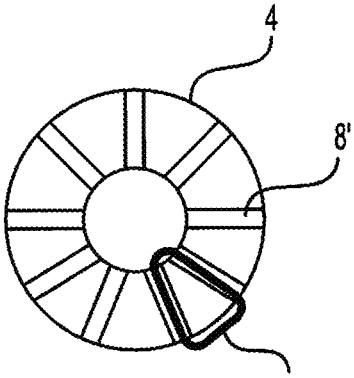

In embodiment of FIGS. 3A-3C, magnetic field generated by permanent magnets 9 runs from permanent magnet rotor 3 to the stator 4 over the air gap 28 substantially in the direction of rotation axis 34 of the rotor 3, such that triggering/activation of safety gear takes place in a non-contact manner.

Figure 3D:
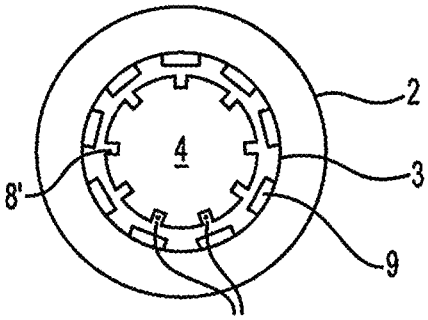

In embodiment of FIG. 3D, stator 4 is arranged inside the permanent magnet rotor 3 such that magnetic field runs from permanent magnet rotor 3 to stator 4 substantially in radial direction, e.g. perpendicular to rotation axis 34 of permanent magnet rotor 3.

Both stator 4 and permanent magnet rotor 3 are made of ferromagnetic material. Rotor 3 is made of iron but stator 4 is made of thin crystal-oriented ferromagnetic dynamo plates to reduce eddy currents. In some other embodiments, rotor is made of non-ferromagnetic material to reduce costs, with the advantage that eddy currents are removed also.

A concentrated stator winding 8 is mounted into stator slots 8'. In FIGS. 3A-3D only one winding 8 loop is presented, but similar loop is arranged around every stator tooth. The winding 8 is disposed in the path of magnetic field generated by the permanent magnets 9 of the permanent magnet rotor 3. Therefore, when permanent magnet rotor 3 rotates it causes a periodically varying magnetic field through the stator winding 8, which induces source voltage in stator winding 8 according to Lenz law. When the end terminals of the stator winding are closed, said source voltage causes current through the stator winding which current brakes movement of the permanent magnet rotor 3 and, consequently, movement of the governor sheave 2 and the safety rope 7. This has the effect that roller 24 moves into the gripping position, causing the safety gear 5 to be activated. Therefore activation of the safety gear 5 does not require any external current source but the energy needed for activation can be retrieved from rotation of permanent magnet rotor 3.

In this embodiment stator winding 8 is arranged as a 3-phase winding but, as a skilled person easily understands, also other phase numbers are possible for achieving a suitable force effect.

Activation of the aforementioned safety gear 5 is controlled by a specific control unit 11. Operation and construction of this control unit 11 is disclosed hereinafter in connection with FIGS. 4A and 4B.

Figure 4A:
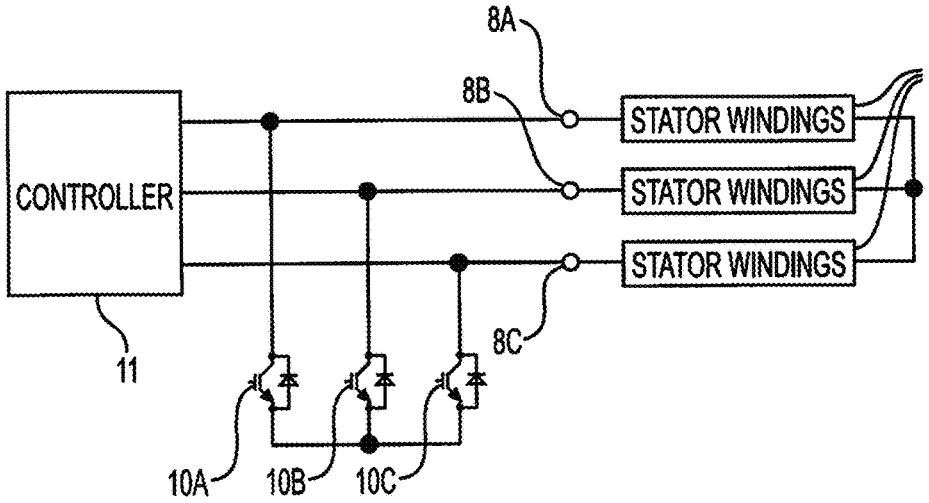
FIGS. 4A and 4B present control means of the overspeed governor of FIG. 1
Figure 4B:
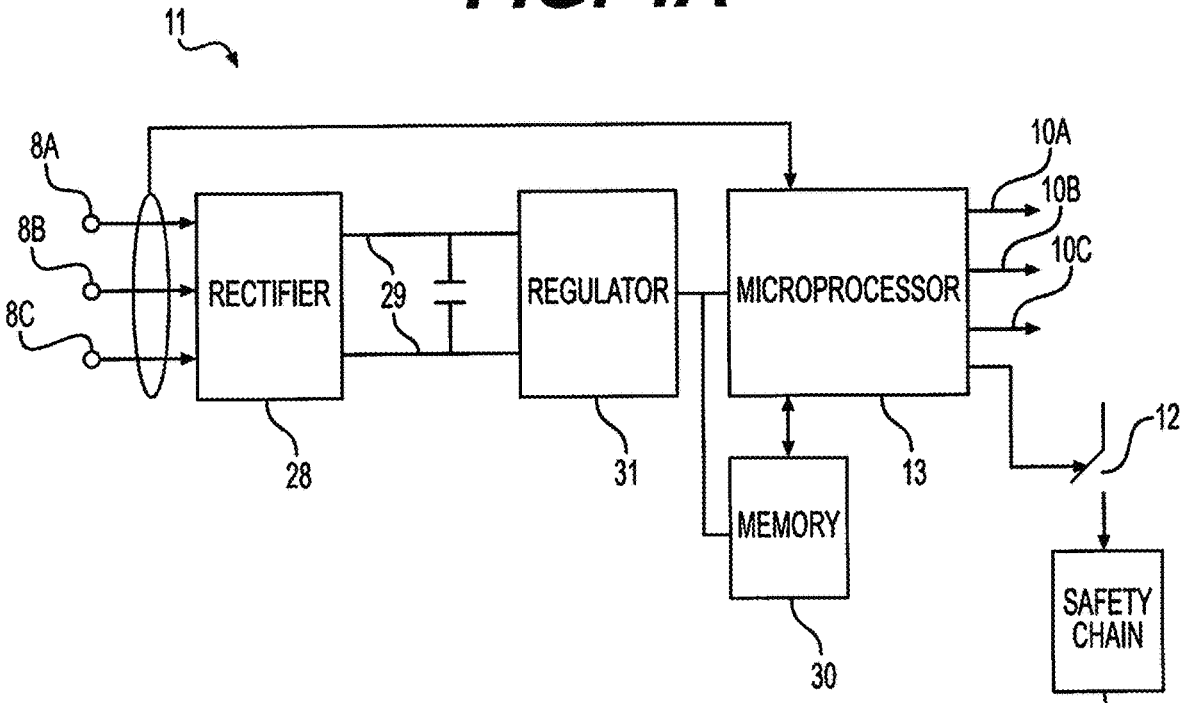

Referring to FIGS. 4A and 4B, overspeed governor 1 comprises controllable switches 10A, 10B, 10C connected to output terminals 8A, 8B, 8C of the stator winding 8 such that the controllable switches 10A, 10B, 10C are operable to selectively open or close the winding 8. These switches 10A, 10B, 10C may be in the form of solid state switches as the igbt transistors in FIG. 4A. Instead of igbt transistors also other suitable solid state switches, such as mosfet—transistors or silicon carbide transistors may be adopted. On the other hand, instead of solid state switches also mechanical switches, such as contactors or relays, may be used.

The control unit 11 is connected to the control poles of the switches 10A, 10B, 10C such that control unit 11 is configured to cause the one or more switches 10A, 10B, 10C to selectively open or close the winding 8 by feeding control signals to the control poles.

Referring to FIG. 4B, control unit 11 comprises a microprocessor 13 and a memory 30 including software performed by the microprocessor. Microprocessor also comprises necessary peripherals (such as (ND converter, line drivers etc.) to perform the control functions disclosed.

Control unit comprises a rectifier 28 coupled to the winding terminals 8A, 8B, 8B. The rectifier 28 rectifies source voltage of the winding 8 to a DC link 29 voltage. When elevator car 6 moves/permanent magnet rotor 3 rotates, microprocessor 13, memory 30 and other electronic components of the control unit 11 receive supply voltage from DC link 29 through regulator 31. This way overspeed governor 1 may be activated also in situations when elevator system is out of power.

Control unit 11 is configured to poll movement of an elevator car 6, to determine an emergency stop situation if movement of the elevator car 6 is different from a desired movement and to cause the one or more switches 10A, 10B, 10C to close the winding 8 based on the determined emergency stop situation. Because governor sheave 2 moves according to elevator car 6 movement, control unit 11 polls movement of the elevator car 6 by polling rotating speed of the permanent magnet rotor 3. For this purpose control unit 11 measures output voltage of the winding 8, that is, voltage of the winding terminals 8A, 8B, 8C caused by source voltage, which is proportional to rotating speed of the permanent magnet rotor 3.

Control unit 11 has threshold values registered in the memory 30. Threshold values are defined as a function of elevator car position such that threshold values are lower in the proximity of elevator hoistway ends. When voltage of any of the terminals 8A, 8B, 8C/speed of elevator car exceeds the corresponding threshold value, control unit 11 activates the safety gear 5 by generating control signals to the control poles of the switches 10A, 10B, 10C such that winding 8 is closed (short-circuited).

To calculate the threshold values, control unit 11 receives position information of elevator car 6 from car position sensors via traveling cable. In some embodiments control unit 11 calculates elevator car 6 position by integrating voltage of the winding terminals 8A, 8B, 8C.

In some embodiments control unit 11 also monitors acceleration/deceleration of elevator car. For this purpose, control unit calculates acceleration/deceleration of elevator car 6 from voltage of the winding terminals 8A, 8B, 8C and activates the safety gear 5 if calculated acceleration/deceleration does not fulfill the allowed conditions registered in memory 30.

In some embodiments control unit 11 also monitors travelled distance of elevator car. For this purpose, control unit calculates travelled distance of elevator car 6 by integrating from voltage of the winding terminals 8A, 8B, 8C and activates the safety gear 5 if calculated distance exceeds threshold value registered in memory 30.

Control unit 11 receives from elevator control unit information about starting of a new elevator run and controls the switches 10A, 10B, 10C to open the winding 8 at the beginning of a new elevator run.

Control unit 11 also receives from elevator control unit information about elevator car 6 entering to a destination floor. Control unit 11 controls the switches 10A, 10B, 10C to close the winding 8 when elevator car enters the destination floor in the end of elevator run. In this case, safety gear will be activated immediately if elevator car 6 starts to move in an uncontrolled manner for some reason after the elevator run has ended.

Control unit 11 further comprises a safety relay 12. Contact of the safety relay 12 is coupled to an elevator safety chain 14 such that safety chain 14 opens when contact of the safety relay 12 opens. As is known, opening of the safety chain 14 causes de-energization of hoisting machine and also activation of the machine brakes to brake rotation of hoisting machine, which causes an emergency stop of the elevator car 6 to occur. Control unit 11 opens the contact of the safety relay 12 when elevator car speed exceeds a registered threshold. In one embodiment, control unit 11 opens the contact of the safety relay 12 when car 6 speed exceeds a first lower threshold and further closes the winding 8 to activate the safety gear 5 if car 6 speed still exceeds a second higher threshold. This way emergency stop may be performed in some cases without activation of the safety gear 5.

In one embodiment, a relay with normally open contacts (N.O.) is used as switches 10A, 10B, 10C for opening/closing the winding 8. In another embodiment a relay with normally closed (N.C.) contacts is used such that each output terminal 8A, 8B, 8C is always closed when the relay is de-energized; thereby activation of safety gear is always possible even if elevator is out of power. In this case current supply to control coil of the relay for opening the relay contacts takes place from an external power source, such as a battery.

Instead of using microprocessor 13/memory 30, control unit may also be implemented with discrete control components, field-programmable gate arrays (FPGAs), relay logic or corresponding.

In some embodiments, instead of directly closing the winding 8, additional components such as resistors and/or capacitors may be coupled to the winding terminals 8A, 8B, 8C such that winding is closed via said additional components.

In some embodiments, current supply to the winding 8 takes place from an external power source. This way is may be possible to selectively activate the safety gear 5 even when elevator car 6 is not moving, by pulling the safety rope 7 by means of permanent magnet rotor 3.

In some embodiments, traditional centrifugal force operated mechanical activation means are added to the above-disclosed overspeed governor 1. This kind of solution makes it possible to reach the advantages of the present invention without compromising any of the requirements of the traditional overspeed governors.

In the preceding the invention is described in connection with an elevator system with counterweight; the solution according to the invention is also suited, however, to elevator systems without counterweight.

The invention is not limited solely to the embodiments described above, but instead many variations are possible within the scope of the inventive concept defined by the claims below.

The invention claimed is:

1. An overspeed governor, comprising:

a governor sheave;

a permanent magnet rotor coupled to the governor sheave;

a safety gear configured to stop movement of an elevator car;

a safety rope fixed to the safety gear, the safety rope configured to run via the governor sheave; and a stator configured to interact with the permanent magnet rotor, the stator including a winding configured to activate the safety gear to brake movement of the elevator car by exerting, when energized, a braking force to the permanent magnet rotor to brake movement of the permanent magnet rotor and stop movement of the governor sheave and the safety rope.

2. The overspeed governor according to claim 1, wherein the winding has output terminals, and the overspeed governor further comprises:

one or more controllable switches connected to the output terminals of the winding such that the one or more controllable switches are configured to selectively open or close the winding.

3. The overspeed governor according to claim 2, wherein the overspeed governor further comprises:

a controller configured to control the one or more controllable switches.

4. The overspeed governor according to claim 3, wherein the controller is configured to control the one or more controllable switches to selectively open or close the winding.

5. The overspeed governor according to claim 3, wherein the controller is configured to, poll movement of the elevator car, determine an emergency stop situation, if movement of the elevator car is different from a desired movement, and cause the one or more controllable switches to close the winding based on the emergency stop situation.

6. The overspeed governor according to claim 5, wherein the movement of the elevator car includes at least one of speed, acceleration, deceleration, and rotated distance of the permanent magnet rotor.

7. The overspeed governor according to claim 3, wherein the controller is configured to, register starting of a run of the elevator car, and cause the one or more controllable switches to open the winding based on the starting of the run of the elevator car.

8. The overspeed governor according to claim 3, wherein the controller is configured to, register the elevator car reaching a destination floor, and cause the one or more controllable switches to close the winding based on the elevator car the reaching the destination floor.

9. The overspeed governor according to claim 5, wherein the controller is configured to poll the movement of the elevator car by polling movement of the permanent magnet rotor.

10. The overspeed governor according to claim 9, wherein the controller is configured to poll movement of the permanent magnet rotor by polling an output voltage of the winding.

11. The overspeed governor according to claim 3, wherein the controller is connected to a safety switch coupled to an elevator safety chain such that the controller is configured to cause the safety switch to open the elevator safety chain in response to an emergency stop situation.

12. The overspeed governor according to claim 1, further comprising:

a tensioning pulley coupled to the safety rope, the tensioning pulley configured to tension the safety rope.

13. The overspeed governor according to claim 1, wherein the permanent magnet rotor includes plurality of permanent magnets arranged sequentially in a rotating direction of the permanent magnet rotor.

14. The overspeed governor according to claim 1, wherein at least one of stator and permanent magnet rotor includes a ferromagnetic material.

15. An elevator, comprising:

the overspeed governor according to claim 1; and the elevator car movable in an elevator hoistway along one or more guide rails, the elevator car having the safety gear mounted thereto to brake the elevator car against the one or more guide rails in response to activation of the safety gear.

* * * * *